US007980262B1

(12) United States Patent
You

(10) Patent No.: US 7,980,262 B1
(45) Date of Patent: Jul. 19, 2011

(54) WINDPROOF UMBRELLA

(76) Inventor: Ching-Chuan You, Taipei (TW)

( * ) Notice: Subject to any disclaimer, the term of this patent is extended or adjusted under 35 U.S.C. 154(b) by 0 days.

(21) Appl. No.: 12/923,324

(22) Filed: Sep. 15, 2010

(51) Int. Cl.
*A45B 25/00* (2006.01)

(52) U.S. Cl. ..... 135/32; 135/33.7

(58) Field of Classification Search ..... 135/31, 135/32, 33.2, 33.7
See application file for complete search history.

(56) References Cited

U.S. PATENT DOCUMENTS

| | | | | |
|---|---|---|---|---|
| 4,979,534 | A | 12/1990 | Johnson et al. | |
| 5,715,853 | A * | 2/1998 | Lin | 135/29 |
| 5,746,235 | A * | 5/1998 | Lin | 135/29 |
| 6,102,058 | A * | 8/2000 | You | 135/29 |
| 6,789,556 | B2 * | 9/2004 | You | 135/31 |
| 6,918,399 | B2 * | 7/2005 | Ko | 135/29 |
| 7,775,226 | B2 * | 8/2010 | MacDonald et al. | 135/31 |
| 2002/0129843 | A1 * | 9/2002 | Wang | 135/29 |
| 2003/0010367 | A1 * | 1/2003 | Ko | 135/32 |

* cited by examiner

*Primary Examiner* — David Dunn
*Assistant Examiner* — Noah Chandler Hawk

(57) ABSTRACT

A windproof umbrella includes a center post (10) including an upper grommet (11), an intermediate fixed ring (12), and a lower sliding runner (13); ribs (20) each having one end (21) pivotably secured to the grommet (11) and the open other end (22); main joints (51) each formed at a portion of the rib (20); stretchers (30) each having one end (31) pivotably secured to the ring (12) and the other end (32) moveably secured to the main joint (51); auxiliary joints (61) each formed at a portion of the stretcher (30); and struts (40) each having one end (41) pivotably secured to the runner (13) and the other end (42) moveably secured to the auxiliary joint (61); a lower canopy (70) secured in covering relation on the ribs (20); and an upper canopy (80) having a peripheral edge positioned over a portion of the lower canopy (70).

5 Claims, 6 Drawing Sheets

WINDPROOF UMBRELLA

BACKGROUND OF THE INVENTION

1. Field of Invention

The invention relates to umbrellas and more particularly to an improved umbrella that is resistant to inversion from the wind.

2. Description of Related Art

Umbrellas are widely used personal articles. It is often that wind will catch an umbrella user unaware and exert a force against an inner surface of a canopy of the umbrella so as to cause the canopy to invert from its normal operable position to an upwardly convex position.

Windproof umbrellas are thus developed for windy weather. For example, U.S. Pat. No. 4,979,534 discloses a windproof comprising a post having a lower end to be grasped by a user and an opposite upper end; a plurality of ribs extending outwardly in a radial direction from the upper end of the post; a lower canopy secured in covering relation on the ribs, the lower canopy including a plurality of vent holes therethrough; a channel forming member secured to the lower canopy in surrounding relation to each lower vent hole for further preventing entry of water therethrough; an upper canopy positioned over the lower canopy in covering relation to all lower vent holes, the upper canopy including at least one upper vent hole therethrough positioned closer to the free ends of the ribs than the at least one lower vent hole, an outer peripheral edge and a plurality of slits extending inwardly in a radial direction from the outer peripheral edge thereof, each slit being arranged generally in line with one rib, the upper canopy having dimensions less than those of the lower canopy; and elastic fastening straps securing the upper canopy between the upper end of the post and the free ends of the ribs with an elastic tautness.

The patent intents to escape excess wind from the vent holes of the lower canopy to the vent hole of the upper canopy. However, in fact, it is difficult of escaping wind through the space between the lower and upper canopies. The windproof umbrella would not be practical since in often times it inverts from its normal position to an upwardly convex position in rainy, windy weather. Thus, the need for improvement still exists.

SUMMARY OF THE INVENTION

It is therefore one object of the invention to provide a windproof umbrella with enhanced and wind resistant frame so as to prevent from being inverted from its normal position to an upwardly convex position in rainy, windy weather.

It is another object of the invention to provide a windproof umbrella capable of distributing strong wind force to a large extent on the canopies and resiliently deforming the canopies with the aid of sliding joints of ribs and stretchers in response to the wind so that the desired wind escape can be achieved.

To achieve the above and other objects, the invention provides a windproof umbrella windproof comprising a center post comprising an upper grommet, an intermediate fixed ring, and a lower sliding runner; a plurality of ribs each having one end pivotably secured to the grommet and the open other end; a plurality of main joints each formed at a portion of the rib proximate to the other end; a plurality of stretchers each having one end pivotably secured to the ring and the other end moveably secured to the main joint; a plurality of auxiliary joints each formed at a portion of the stretcher; and a plurality of struts each having one end pivotably secured to the runner and the other end moveably secured to the auxiliary joint; a lower canopy secured in covering relation on the ribs; and an upper canopy having a center secured to the grommet and an outer peripheral edge positioned over a portion of the lower canopy in covering relation to all of the main joints.

The above and other objects, features and advantages of the invention will become apparent from the following detailed description taken with the accompanying drawings.

DETAILED DESCRIPTION OF THE INVENTION

Figure 1:
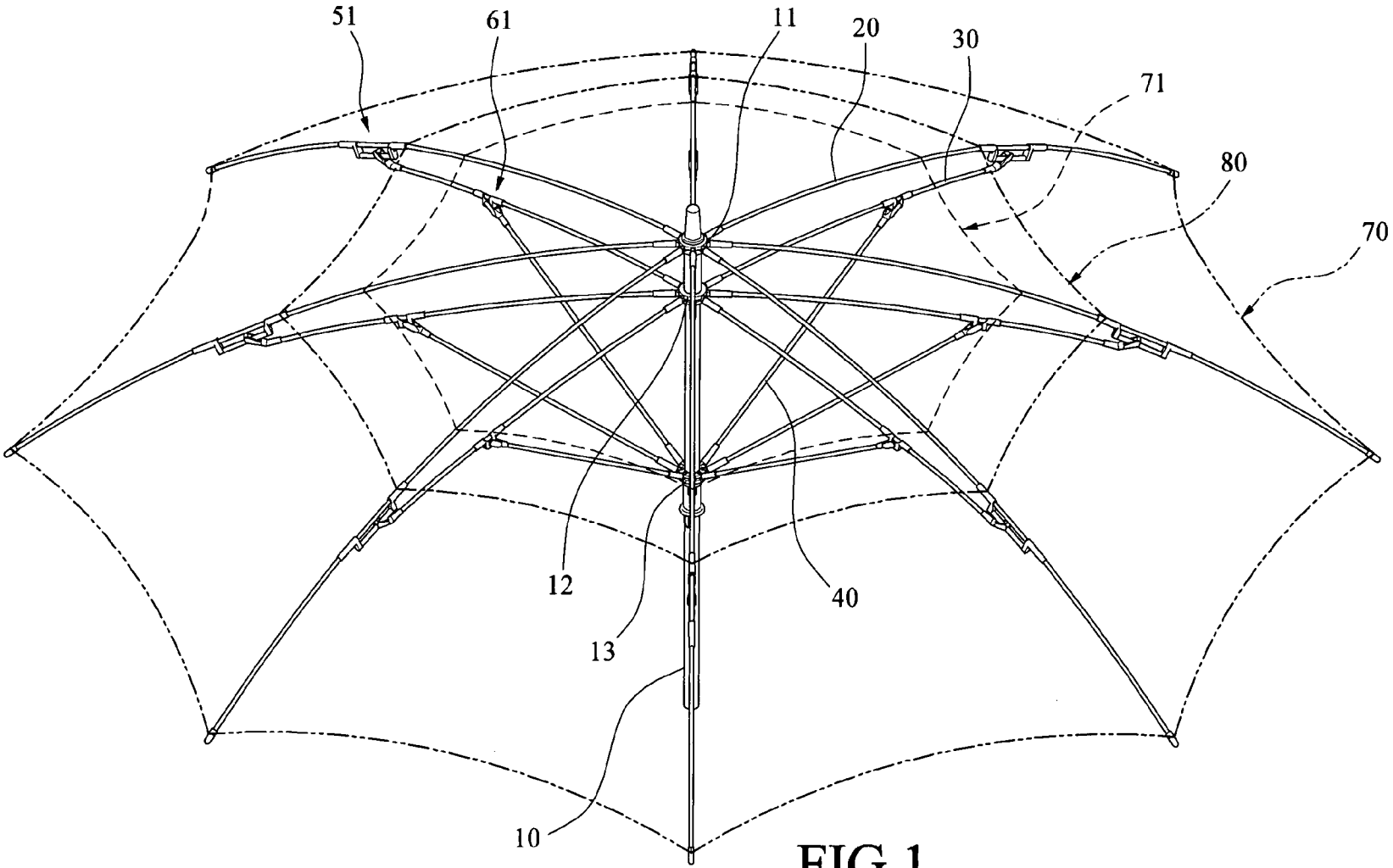
FIG. 1 is a perspective view of the frame of a windproof umbrella according to the invention, the umbrella being open and the canopies being shown in phantoms.
Figure 2:
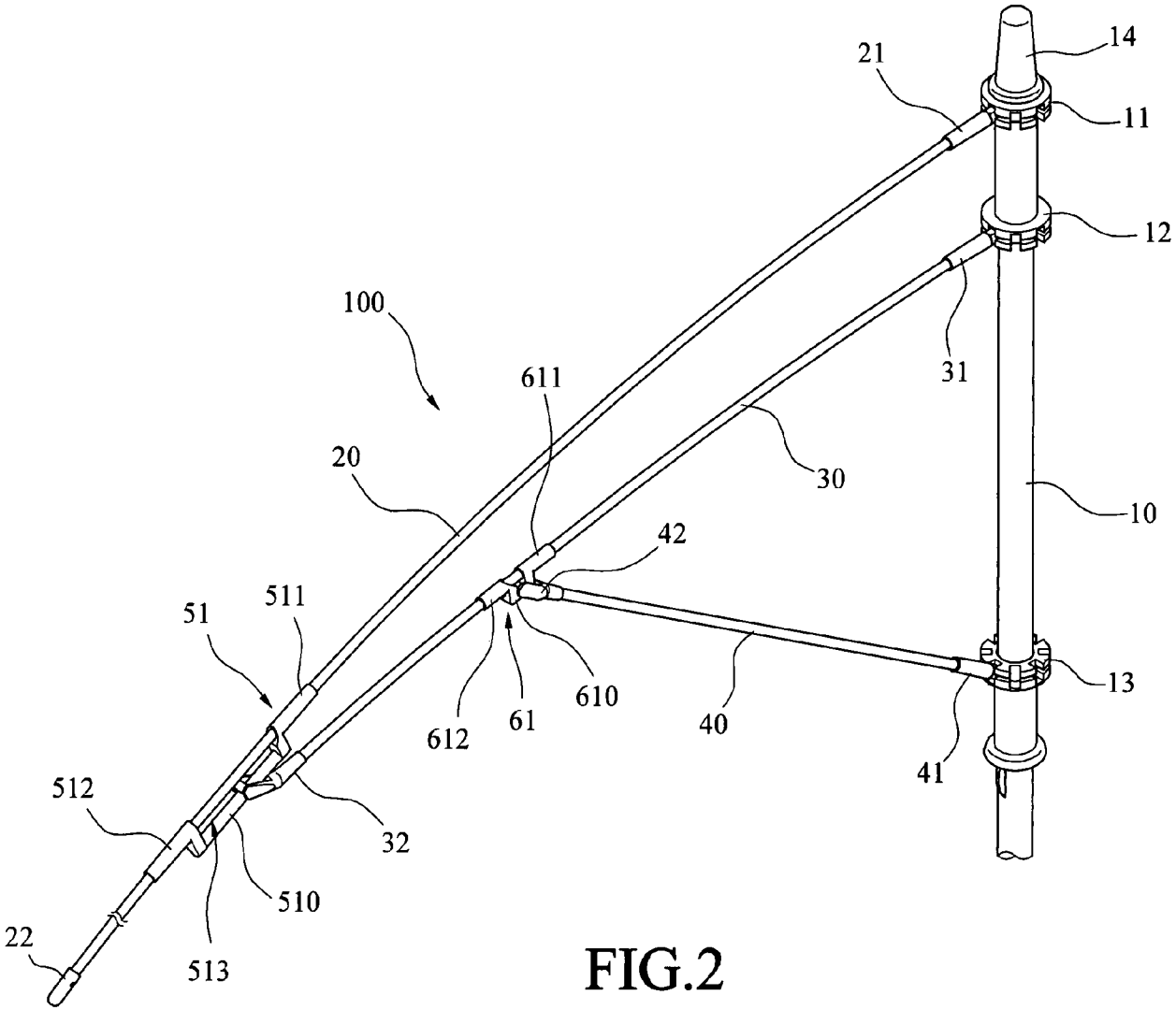
FIG. 2 is a fragmentary view of the umbrella.
Figure 3:
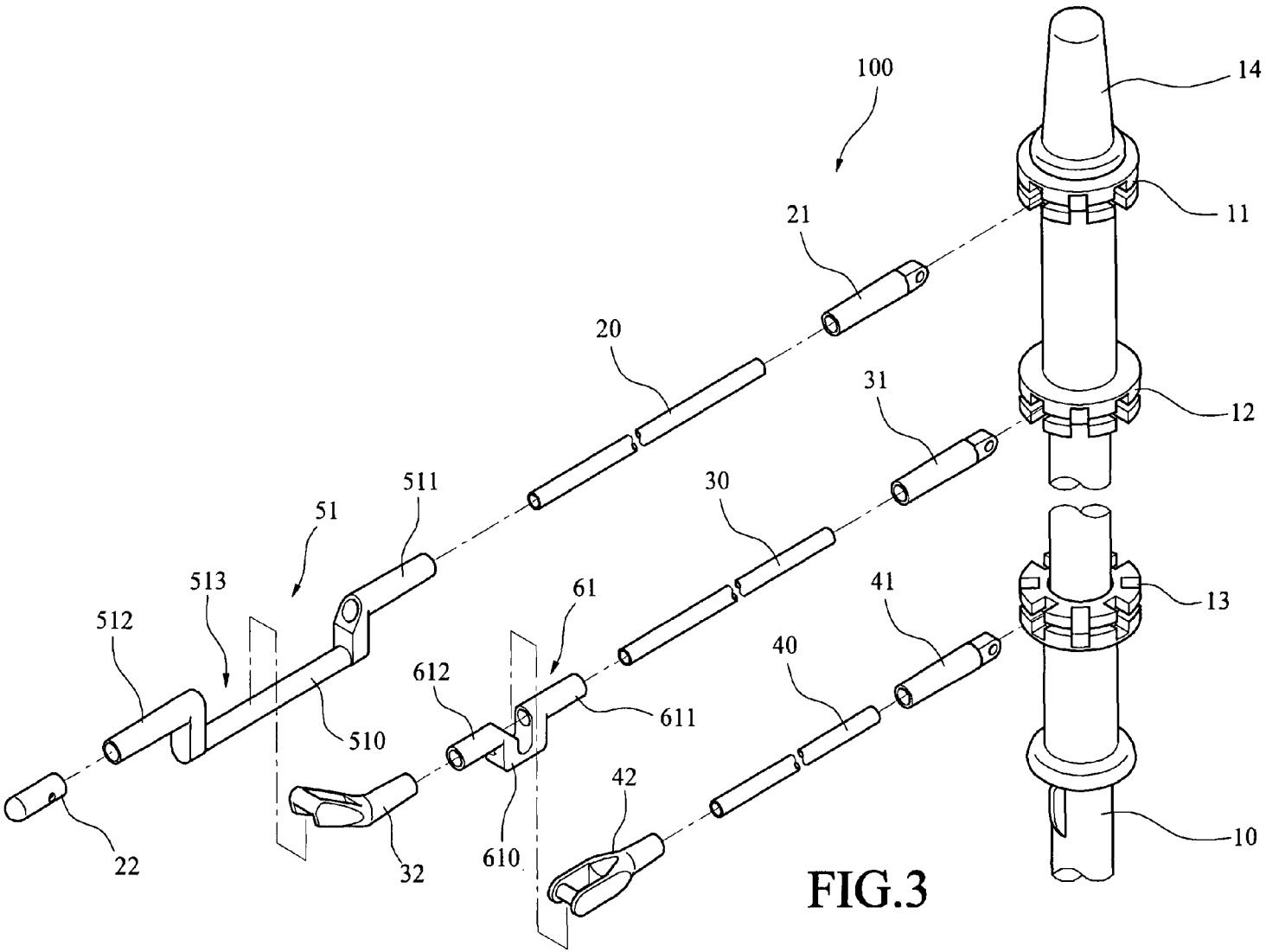
FIG. 3 is an exploded view of FIG. 2.
Figure 4:
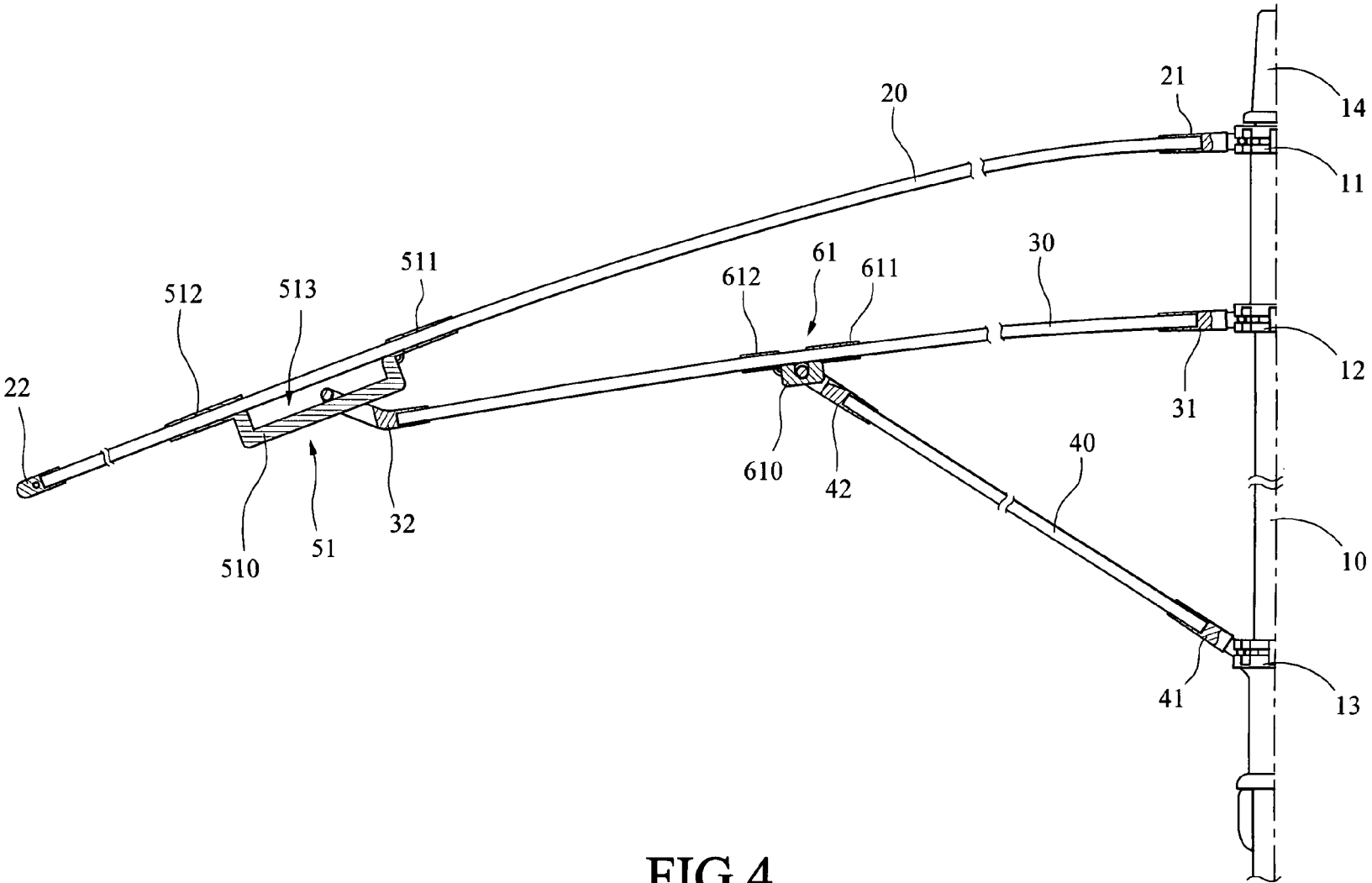
FIG. 4 is a side elevation in part section of FIG. 2.

Referring to FIGS. 1 to 6, a windproof umbrella 100 in accordance with the invention comprises the following components as discussed in detail below.

A center post 10 comprises a top ferrule 14, an upper grommet 11, an intermediate fixed ring 12 under the grommet 11, and a lower sliding runner 13 under the ring 12. A plurality of ribs 20 each has one end 21 pivotably secured to the grommet 11 and the other open end 22. A plurality of main joints 51 each is formed at a portion of the rib 20 proximate to the other end 22. The main joint 51 is shaped as U and comprises a first tubular end 511, a second tubular end 512, a U-shaped bar 510 interconnecting the first and second tubular ends 511, 512, and a channel 513 defined by the bar 510, the first and second tubular ends 511, 512, and a portion of the rib 20 passing through the first and second tubular ends 511, 512.

The characteristic structure of the windproof umbrella 100 in accordance with the invention is that a plurality of stretchers 30 each has one end 31 pivotably secured to the ring 12 and the other end 32 shaped as a closed loop, the other end 32 being put on the bar 510 of the main joint 51 to be moveably restrained in a wide channel 513 with a large moveable extent, and a plurality of auxiliary joints 61 each is formed at an intermediate portion of the stretcher 30 with the increased supports of a plurality of struts 40 to reinforce the whole strength of the windproof umbrella 100 of the invention. The auxiliary joint 61 is shaped as U and comprises a first tubular end 611, a second tubular end 612, a U-shaped bar 610 interconnecting the first and second tubular ends 611, 612, and a tunnel (not numbered) defined by the bar 610, the first and second tubular ends 611, 612, and the stretcher 30 passing through the first and second tubular ends 611, 612. The plurality of struts 40 each has one end 41 pivotably secured to the runner 13 and the other end 42 shaped as a closed loop, the other end 42 being put on the bar 610 to be moveably restrained in the tunnel.

A lower canopy 70 is secured in covering relation on the ribs 20. In detail, an inner closed edge of the lower canopy 70 is secured to points the ribs 20 covering the main joints 51 and an outer peripheral edge thereof is secured to the other ends 22 of the ribs 20.

An upper canopy 80 has its center secured to the grommet 11 and its outer peripheral edge positioned over a portion of inner peripheral edge of the lower canopy 70 in covering relation to all main joints 51. That is, the main joints 51 are covered by both the lower and upper canopies 70, 80 so as to form a plurality of pairs of communicating inner and outer vent holes 71, 81 in which each pair of communicating inner and outer vent holes 71, 81 is defined by the lower and upper canopies 70, 80, portions of any two adjacent ribs 20 proximate to the main joints 51, and the main joints 51.

Figure 5:
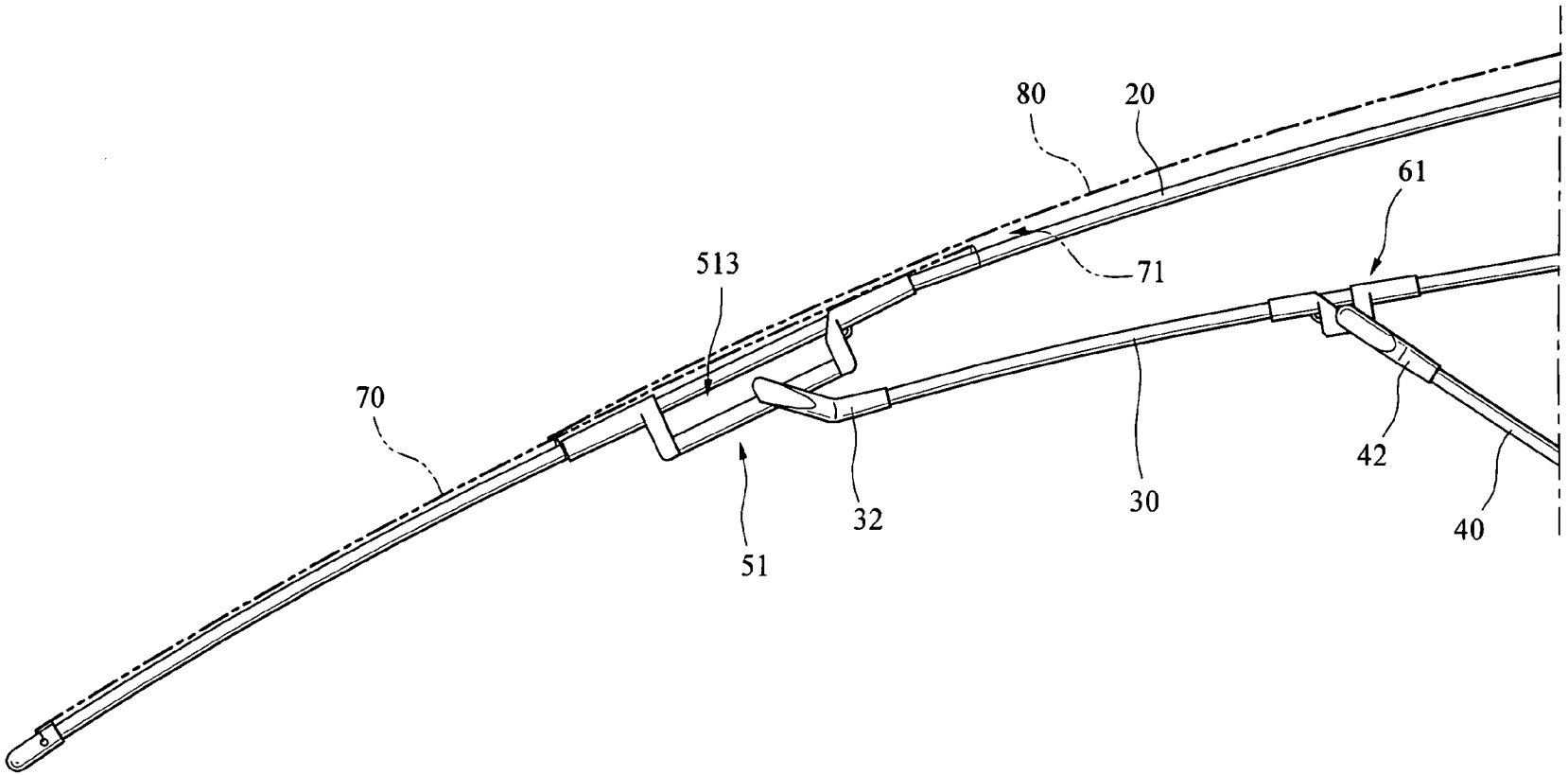
FIG. 5 is a fragmentary view of FIG. 4 showing a state of the umbrella prior to wind blowing from below.
Figure 6:
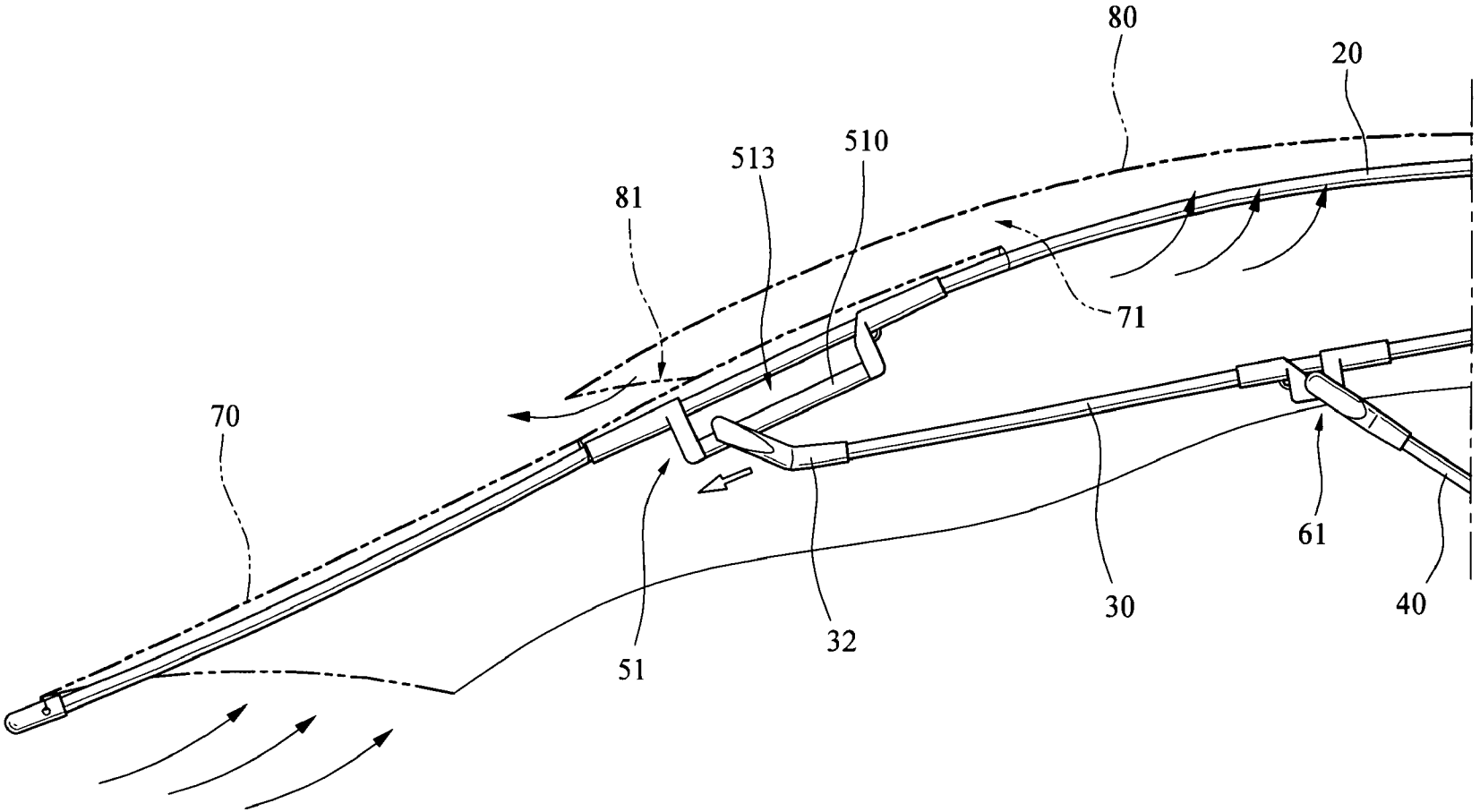
FIG. 6 is a view similar to FIG. 5 showing a state of the umbrella in response to strong wind blowing from below.

As shown in FIGS. 5 and 6, during rainy, windy weather, wind (as indicated by arrows) caught beneath the canopies 70, 80 of the umbrella 100 may apply pressure to the undersides of the canopies 70, 80. This force causes the portion of the upper canopy 80 proximate to the main joints 51 to lift away from the portion of the lower canopy 70 proximate to the main joints 51. As such, a plurality of pairs of communicating inner and outer vent holes 71, 81 are formed. Also, the other ends 32 of the stretchers 30 slide toward the outer direction as indicated by arrow in FIG. 6. Therefore, wind can pass through the pairs of communicating inner and outer vent holes 71, 81 for escape from the umbrella 100. It is contemplated by the invention that any excessive wind will not invert the umbrella 100 due to the above descriptions and this is the characteristics of the invention.

During rainy, windy weather, wind caught beneath the canopies 70, 80 of the umbrella 100 may apply pressure to the undersides of the canopies 70, 80. This force causes the portion of the upper canopy 80 proximate to the main joints 51 to lift away from the portion of the lower canopy 70. As discussed above, the other ends 32 of the stretchers 30 are freely and moveably restrained by the main joints 51 in a larger range and the struts 40 are pivotably secured to the auxiliary joints 61. The ribs 20 may flexibly bend upward to cause the other ends 32 of the stretchers 30 to slide toward the outer direction (as indicated by arrow in FIG. 6). Also, the stretchers 30 may flexibly bend upward to cause the other ends 42 of the struts 40 to pivot clockwise about the auxiliary joints 61. The flexible nature of the ribs 20 and the stretchers 30 in cooperation with the moveable other ends 32 of the stretchers 30 at the main joints 51, and the pivotal connections of the struts 40 and the stretchers 30 at the auxiliary joints 61 can prevent the umbrella 100 from being inverted when strong wind blows.

The moveably restrained of the other ends 32 of the stretchers 30 in the main joints 51 is the first connection force of the stretchers 30 and the ribs 20 and this can achieve an increased flexible adjustment of the ribs 20. Further, the channels 513 of the main joints 51 can provide a large extent of the flexible deformation of the ribs 20 and thus increase the resistance of the ribs 20 against excessive wind. The pivotal fastening of the other ends 42 of the struts 40 at the auxiliary joints 61 is the second connection force of the struts 40 and the stretchers 30. The ribs 20 may bend upward to pull the overlap of the canopies 70, 80 away from each other to form a plurality of pairs of communicating inner and outer vent holes 71, 81. Advantageously, excessive wind may escape via the pairs of communicating inner and outer vent holes 71, 81. This is the flexible deformation characteristic of the umbrella 100 for resisting inversion from excessive wind. The umbrella 100 may return to its original shape when excessive wind is successfully vented. This wind escape characteristic of the windproof umbrella 100 with an aid of the reinforced configuration in a larger movable range of the main joints 51 and the auxiliary joints 61, together with the second connection force of the struts 40 and the stretchers 30 is unique and novel and can be effectively resistant to inversion from the excessive wind.

While the invention has been described in terms of preferred embodiments, those skilled in the art will recognize that the invention can be practiced with modifications within the spirit and scope of the appended claims.

What is claimed is:

1. A windproof umbrella comprising:

a center post (10) comprising an upper grommet (11), an intermediate fixed ring (12), and a lower sliding runner (13);

a plurality of ribs (20) each having one end (21) pivotably secured to the grommet (11) and an other, open end (22);

a plurality of main joints (51) each formed at a portion of the rib (20) proximate to the other end (22);

a plurality of stretchers (30) each having one end (31) pivotably secured to the ring (12) and the other end (32) slidably and pivotally secured to the main joint (51);

a plurality of auxiliary joints (61) each formed at a portion of the stretcher (30); and a plurality of struts (40) each having an one end (41) pivotably secured to the runner (13) and an other end (42) moveably secured to the auxiliary joint (61);

a lower canopy (70) secured in covering relation on the ribs (20); and an upper canopy (80) having a center secured to the grommet (11) and an outer peripheral edge positioned over a portion of the lower canopy (70) in covering relation to all of the main joints (51), wherein wind caught beneath the canopies (70, 80) applies pressure to the canopies (70, 80) to cause a portion of the upper canopy (80) to lift away from a portion of the lower canopy (70) to form a plurality pairs of communicating inner and outer vent holes (71,81) with the other ends (32) of the stretchers (30) sliding away from the center post (10), each pair of the inner and outer vent holes (71, 81) being defined by the portions of the upper and lower canopies (70, 80), the adjacent ribs (20), and the adjacent main joints (51).

2. The windproof umbrella of claim 1, wherein the main joint (51) comprises a first tubular end (511), a second tubular end (512), a U-shaped bar (510) interconnecting the first and second tubular ends (511, 512), and a channel (513) defined by the bar (510), the first and second tubular ends (511, 512), and a portion of the rib (20) passing through the first and second tubular ends (511, 512).

3. The windproof umbrella of claim 2, wherein the other end (32) of the stretcher (30) is shaped as a closed loop and put on the bar (510) to be moveably restrained in the channel (513).

4. The windproof umbrella of claim 1, wherein the auxiliary joint (61) comprises a first tubular end (611), a second tubular end (612), and a U-shaped bar (610) interconnecting the first and second tubular ends (611, 612).

5. The windproof umbrella of claim 4, wherein the other end (42) of the strut (40) is shaped as a closed loop and moveably put on the bar (610) in restrain.

* * * * *